US010814669B2

(12) United States Patent
Buhlmann

(10) Patent No.: US 10,814,669 B2
(45) Date of Patent: Oct. 27, 2020

(54) METHOD FOR PRODUCING A PRINTED DECORATIVE PANEL

(71) Applicant: SURFACE TECHNOLOGIES GMBH & CO. KG, Baruth (DE)

(72) Inventor: Carsten Buhlmann, Rangsdorf (DE)

(73) Assignee: SURFACE TECHNOLOGIES GMBH & CO. KG, Baruth (DE)

( * ) Notice: Subject to any disclaimer, the term of this patent is extended or adjusted under 35 U.S.C. 154(b) by 0 days.

(21) Appl. No.: 16/072,035

(22) PCT Filed: Jan. 24, 2017

(86) PCT No.: PCT/EP2017/051435
§ 371 (c)(1),
(2) Date: Jul. 23, 2018

(87) PCT Pub. No.: WO2017/129566
PCT Pub. Date: Aug. 3, 2017

(65) Prior Publication Data

US 2019/0023061 A1 Jan. 24, 2019

(30) Foreign Application Priority Data

Jan. 25, 2016 (EP) ..... 16152633

(51) Int. Cl.
*B44C 5/04* (2006.01)
*B41M 7/00* (2006.01)
(Continued)

(52) U.S. Cl.
CPC ..... *B44C 5/043* (2013.01); *B41M 7/0081* (2013.01); *B44C 5/04* (2013.01); *B44C 1/24* (2013.01); *B44C 5/06* (2013.01)

(58) Field of Classification Search
CPC ..... B05D 1/00; B05D 3/108
See application file for complete search history.

(56) References Cited

U.S. PATENT DOCUMENTS 7,645,010 B2 1/2010 Otsuka
2005/0018026 A1* 1/2005 Nerad ..... B41J 3/28 347/102

(Continued)

FOREIGN PATENT DOCUMENTS

CN 1826230 A 8/2006
CN 104870192 A 8/2015

(Continued)

*Primary Examiner* — Dah-Wei D. Yuan
*Assistant Examiner* — Kristen A Dagenais-Englehart
(74) *Attorney, Agent, or Firm* — Harness, Dickey & Pierce, P.L.C.

(57) ABSTRACT

The disclosure relates to a method for producing a printed panel, comprising the following steps: a) providing a flat carrier; b) optionally applying a resin layer to the flat carrier; c) optionally applying a paper layer or nonwoven layer to the flat carrier; d) optionally calendering the produced layer structure, in particular at a temperature between ≥40° C. and ≤250° C., and e) optionally applying a printing substrate to the flat carrier; characterized in that the method has the following further steps: f) printing an application amount of radiation-curing printing ink onto the carrier, and g) curing the previously applied printing ink by treating the printing ink with radiation, wherein h) at least one parameter of radiation used in step g) is adapted to an application amount of radiation-curing printing ink, wherein step h) is based on an application amount of the radiation-curing printing ink determined by a sensor during the printing process, wherein at least one parameter of radiation used in step g) is adapted during the printing on the carrier according to step f).

8 Claims, 3 Drawing Sheets

(51) Int. Cl.
*B44C 1/24* (2006.01)
*B44C 5/06* (2006.01)

(56) References Cited

U.S. PATENT DOCUMENTS

| | | | | |
|---|---|---|---|---|
| 2007/0040885 | A1 | 2/2007 | Kusunoki | |
| 2008/0259108 | A1* | 10/2008 | Otsuka | B41J 2/04535 347/14 |
| 2009/0085946 | A1* | 4/2009 | Aoki | B41J 2/04588 347/11 |
| 2012/0139994 | A1* | 6/2012 | Ganapathiappan | C07D 487/22 347/19 |
| 2012/0176436 | A1 | 7/2012 | Usuda et al. | |
| 2017/0008334 | A1 | 1/2017 | Hoff | |

FOREIGN PATENT DOCUMENTS

| | | | |
|---|---|---|---|
| EP | 1918108 | A1 | 5/2008 |
| EP | 2829416 | A1 | 1/2015 |
| EP | 2910385 | A1 | 8/2015 |

* cited by examiner

METHOD FOR PRODUCING A PRINTED DECORATIVE PANEL

CROSS-REFERENCE TO RELATED APPLICATIONS

This application is a National Stage of International Application No. PCT/EP2017/051435, filed on Jan. 24, 2017, and published in German as WO2017/129566 A1 on Aug. 3, 2017. This application claims the priority to European Patent Application No. 16152633.0, filed on Jan. 25, 2016. The entire disclosures of the above applications are incorporated herein by reference.

FIELD

The present disclosure relates to a method for producing a printed decorative panel. In particular, the present disclosure relates to a method for producing a printed decorative panel by use of radiation-curable ink, which enables an improved curing of the radiation-curable ink.

BACKGROUND

This section provides background information related to the present disclosure which is not necessarily prior art.

Decorative panels, for example, for interior design, are known per se. So far, such decorative panels are often produced as laminates, in which a decorative paper preprinted with a desired decoration is applied onto a carrier plate and in turn a so-called overlay is applied onto the decorative paper. Furthermore, direct printing processes are known in which the carrier plate itself or a non-printed paper applied onto the carrier plate is printed.

As further treatment steps, it may be provided, for example, to apply wearing or cover layers on top of the decorative layer in order to protect the applied decorative layer. A wearing and/or cover layer in the sense of the disclosure is a layer applied as an outer finish which in particular protects the decorative layer from wear or damage by dirt, moisture or mechanical influences, such as abrasion.

In many cases it is provided that in such wearing or cover layers a surface texture matching with the decoration is introduced. A surface texture matching with the decoration means that the surface of the decorative panel has a haptically perceptible structure, which corresponds to the applied decoration with respect to the shape and the pattern, so as to obtain a replication of a natural material with respect to the feeling as faithful as possible.

A problem that can occur in direct printing on decorative panels is that the printed ink or the decoration often has to be completely dried prior to further treatment steps, so as to ensure a high quality of the decoration. This can possibly reduce the production speed. Such a problem may equally apply to the printing of a paper applied to a carrier plate as well as to the directly printing of the carrier plate.

EP 1918108 A1 in particularly relates to an ink composition and an inkjet printing process, wherein in particular radiation-curable compositions are described. The substrate to be printed is in particular paper, glass, plastic, films, metal and circuit boards. It is further generally described that the conditions used for the irradiation are selected based on the predetermined amount and thickness of the ink adhering to the substrate.

US 2007/0040885 A1 describes a printing process and an arrangement for printing in particular a paper by use of radiation-curable ink. In this case, it is provided in particular that the ink has curing initiators which are active for radiation of different wavelengths, so that first a partial curing and then a final curing can take place. It is further described that a control unit is provided which controls the radiation energy of a radiation unit depending on the type of the ink and the amount of ink applied to a substrate. In this case, the amount of ink is determined based on an image to be printed that is based on predetermined data.

US 2012/0176436 A1 relates to a printing process such as the printing of paper. It should in particular be provided that ink is applied to the substrate to be printed and is irradiated from the opposite side to achieve a curing of the ink. It is described that the radiation amount or the irradiation time is adjusted based on the amount of ink which is applied to the substrate to be printed. This is done on the basis of predetermined print data.

SUMMARY

This section provides a general summary of the disclosure, and is not a comprehensive disclosure of its full scope or all of its features.

With this in mind, it is the object of the present disclosure to provide a method for producing a decorative panel, which is able to overcome at least partially at least one of the problems known from prior art. In particular, it is the object of the present disclosure to provide a method for producing a decorative panel, which allows an improved application of a decoration by means of a printing process.

This problem is achieved by a method according to claim 1. This object is further achieved by an apparatus according to claim 10. Preferred embodiments of the disclosure are given in the dependent claims and in the further description and the figures, wherein the further features described individually or in any combination may represent a part of the disclosure, unless the contrary explicitly results from the context.

A method for producing a printed panel is proposed, comprising the steps:

a) providing a plate-shaped carrier;
b) optionally applying a resin layer onto the plate-shaped carrier;
c) optionally applying a paper or nonwoven layer onto the plate-shaped carrier;
d) optionally calendering the resulting layer structure, in particular at a temperature between ≥40° and ≤250° C.;
e) optionally applying a printing substrate onto the plate-shaped carrier, wherein the method comprises the further steps:
f) printing the carrier with an application amount of radiation-curable printing ink; and
g) curing the previously applied printing ink by treating the printing ink with radiation, wherein
h) at least one parameter of the radiation used in step g) is adapted to the application amount of radiation-curable printing ink, wherein step h) is based on an amount of the radiation-curable printing ink determined by at least one sensor during the printing process, wherein at least one parameter of the radiation used in step g) is adjusted during the printing of the carrier according to step f).

Surprisingly, it has been found that an improved application of the decoration onto a carrier plate or on a paper disposed on the carrier plate can be obtained by the method described above.

The term decorative panel in the sense of the disclosure means in particular wall, ceiling, door or floor panels comprising a decoration applied onto a carrier plate. Decorative panels are used in a variety of ways both in the field of interior design of rooms and for decorative claddings of buildings, for example in exhibition stand construction. One of the most common application fields of decorative panels is their use as floor covering. Herein, the decorative panels often comprise a decoration intended to replicate a natural material.

Examples of such replicated natural materials are wood species such as maple, oak, birch, cherry, ash, walnut, chestnut, wenge or even exotic woods such as Panga-Panga, mahogany, bamboo and bubinga. In addition, often natural materials such as stone surfaces or ceramic surfaces are replicated.

In the sense of the disclosure, the term "direct printing" refers to the application of a decoration directly onto the carrier of a panel or onto a non-printed fiber material layer applied onto the carrier. In contrast to conventional methods, in which a decorative layer previously printed with a desired decoration is applied onto a carrier, in direct printing the printing of the decoration takes place directly in the course of the surface coating or the panel production. Here, various printing techniques, which are able to work with printing inks such as in particular digital printing techniques, for example, inkjet methods or laser printing methods can be used.

In the sense of the disclosure the term fiber materials means materials such as paper and nonwoven fabrics on the basis of plant, animal, mineral or even synthetic fibers as well as cardboards. Examples of fiber materials on the basis of plant fibers in addition to papers and nonwoven fabrics made of cellulose fibers are boards made of biomass such as straw, maize straw, bamboo, leaves, algae extracts, hemp, cotton or oil palm fibers. Examples of animal fiber materials are keratin-based materials such as wool or horsehair. Examples of mineral fiber materials are mineral wool or glass wool.

In the method described above, according to step a) first a plate-shaped carrier is provided. The carrier provided according to step a) can be configured in a manner known per se for the production of decorative panels. Depending on the desired field of application of the decorative panels, the carrier may be made of different materials. In particular, the material of the carrier can be selected depending on the field of application. Thus, for example, the carrier can consist of or comprise a wood-based material, provided that the decorative panel is not exposed to excessive moisture or weather conditions. On the other hand, if the panel is to be used e.g. in wet rooms or outdoors, the carrier may for example consist of or comprise a plastic material.

Wood-based materials in the sense of the disclosure in addition to solid wood materials are materials such as cross-laminated timber, glue-laminated timber, blockboard, veneered plywood, laminated veneer lumber, parallel strand lumber and bending plywood. In addition, wood-based materials in the sense of the disclosure are also chipboards such as pressboards, extruded boards, oriented structural boards (OSB) and laminated strand lumber as well as wood fiber materials such as wood fiber insulation boards (HFD), medium hard and hard fiberboards (MB, HFH) and in particular medium density fiberboards (MDF) and high density fiberboards (HDF). Even modern wood-based materials such as wood polymer materials (wood plastic composite, WPC), sandwich boards made of a lightweight core material such as foam, rigid foam or honeycomb paper and a layer of wood applied thereto, and minerally hardened, for example with cement, chipboards are wood-based materials in the sense of the disclosure. Moreover, cork represents a wood-based material in the sense of the disclosure.

Plastic materials which can be used for producing corresponding panels are, for example, thermoplastic plastic materials such as polyvinyl chloride (PVC), polyolefines (such as polyethylene (PE), polypropylene (PP)), polyamides (PA), polyurethanes (PU), polystyrene (PS), acrylonitril butadiene styrene (ABS), polymethyl methacrylate (PMMA), polycarbonate (PC), polyethylene terephthalate (PET), polyether ether ketone (PEEK) or mixtures or copolymerizates thereof. For example, a co-polymerizate of polyethylene and polypropylene may be used in a ratio of 1/1. Moreover, as an example a wooden material and a polymer may be suitable, which may be present in a ratio of 40/60 to 70/30, such as 50/50. As polymeric components polypropylene, polyethylene or a copolymer of the two aforementioned materials can be used, wherein further wood flour may be used as a wooden component. The plastic materials can basically include common fillers, such as calcium carbonate (chalk), alumina, silicagel, quartz powder, wood flour, talcum.

For plastic-based panels, such as based on polyvinylchloride, as well as in WPC-based panels, such as based on polypropylene and/or polyethylene, mineral fillers may be of advantage. Here, talcum or talc or calcium carbonate (chalk), aluminum oxide, silica gel, silica flour, wood flour and gypsum are particularly suitable. The amount of mineral fillers, such as talcum, may be in a range of ≥30 wt.-% to ≤80 wt.-%, such as from ≥45 wt.-% to ≤70 wt.-%. By means of fillers, in particular by means of chalk, the slip of the carrier can be improved. With the use of talcum, for example, an improved heat resistance and moisture resistance may be achieved. For example, talcum can be used as filler in a WPC material, such as with a wood component, such as wood fibers together with a plastic material, as described above, or even with pure plastic material. Moreover, the mineral fillers may be colored in a known manner. For example, a mixture of talcum and polypropylene may be provided in which talcum is present in the abovementioned amount range such as at 60 wt.-%. In particular, it can be provided that the plate material comprises a flame retardant.

Such a carrier is provided with a decoration in a method described above. For this purpose, the carrier can be printed by use of a radiation-curable printing ink, as described in detail below.

Printing of the carrier can be realized in the sense of the disclosure directly on the carrier or within the scope of the present disclosure also on a fibrous material web or another suitable printing substrate of the carrier and thus indirectly on the carrier. Thus, printing of the carrier similar to the application of a layer onto the carrier or the application of a material on to the carrier may be understood as the direct printing of the carrier or the application of a layer directly on or the application of a material onto the carrier as well as indirectly on a layer disposed on the carrier.

As far as the printing on a fibrous material web or on a paper or nonwoven layer is to be carried out, it may be provided that first the paper or nonwoven layer is applied onto the carrier and printed directly or is provided with a printing substrate and subsequently printed.

In the case of application of the paper or nonwoven layer, a resin layer can preferably be applied onto the plate-shaped carrier subsequently to step a) according to step b), which can serve as an adhesive for fixing the paper or nonwoven layer. In this case, a resin composition known per se may be used in this step. Furthermore, this step can be applied by use of application rollers.

For the application of the resin layer in step b) it can preferably be provided that a resin composition is applied which comprises at least one compound selected from the group consisting of melamine resin, formaldehyde resin, urea resin, phenolic resin, epoxy resin, unsaturated polyester resin, diallyl phthalate or mixtures thereof as a resin component. In this case, the resin composition may be applied, for example, in an application rate between ≥5 g/m$^2$ and ≤50 g/m$^2$, preferably ≥10 g/m$^2$ and ≤40 g/m$^2$. Particularly preferably, the application amount of the resin composition is chosen so that the paper or nonwoven applied in the subsequent step c) is not completely impregnated with the resin composition. Preferably, a penetration of the resin layer can be prevented prior to the printing by appropriately selecting the type and amount of the applied resin layer. For this purpose, it may, for example, also be provided that the resin composition is applied in step b) with a kinematic viscosity which corresponds to a flow time between ≥10≤s and 40 s from a standard flow cup (as measured according to DIN 53211).

Subsequently, according to step c) the paper or nonwoven layer can be applied onto the plate-shaped carrier or onto the resin layer. Here, it may be provided that in step c) a paper or nonwoven with a grammage between ≥30 g/m$^2$ and ≤80 g/m$^2$, preferably between ≥40 g/m$^2$ and ≤70 g/m$^2$ is applied onto the plate-shaped carrier. The application of the paper or the nonwoven can, for example, be realized by use of suitable feed rollers which guide the paper or nonwoven in such a way that it is disposed onto the carrier.

After the application of the paper or nonwoven layer step d) may be followed by calendering the resulting layer structure, in particular at a temperature between ≥40° C. and ≤250° C. This step can be carried out in a manner known per se by a layer formation process by means of a calender which comprises calendering rollers and which treats the layer structure with pressure and/or heat. During calendering, the resin layer may remain uncured or may preferably be partially or fully cured.

In the event that the method includes the application of a paper or nonwoven and thus, for example, the steps b) to d), the printing of the carrier according to step e) is carried out following the calendering according to step c) or subsequently to the application of a printing substrate in particular on the calendered layer structure, as described below. The following statements apply likewise, if a paper or nonwoven layer is dispensed with and the printing substrate is applied directly onto the carrier.

Such a printing substrate comprises, for example, a resin system, for example comprising a melamine resin. For example, in order to produce the printing substrate, a successive two-time application of a respective resin composition while forming two resin-containing layers can be carried out by use of the steps: forming a first resin-containing layer by use of a resin composition comprising a mixture of melamine resin and urea resin, and forming a second resin-containing layer by use of a resin composition comprising a proportion of melamine resin in the resin component in a range of ≥95 wt.-%, more preferably ≤99 wt.-%.

In principle, the printing substrate can be implemented in one or more layers, wherein each of the layers may comprise or consist of a resin component. Incidentally, in each layer, the resin may include or consist of, for example, urea resin or melamine resin, so that the content of urea resin in the resin component may be, for example, from ≥0 wt.-% to ≤100 wt.-%, wherein the remainder may consist of, for example, melamine resin and/or wherein the proportion of melamine resin in the resin component may be, for example, from ≥0 wt.-% to ≤100 wt.-%, wherein the remainder may consist of, for example, urea resin.

In principle, the respective resin composition can comprise, for example, a resin content between ≥15 wt.-% and ≤95 wt.-%, preferably between ≥20 wt.-% and ≤90 wt.-%, more preferably between ≥25 wt.-% and ≤65 wt.-%.

Furthermore, the first resin-containing layer can be applied with a mixture comprising only melamine resin and urea resin in the resin component. In this case, melamine resin can be present in the resin component for example in a proportion in a range of ≥55 wt.-% to ≤90 wt.-%, for example ≥60 wt.-% to ≤80 wt.-%, such as 70 wt.-%, wherein the remaining portion of the resin component may each be formed of urea resin. For example, the first resin-containing layer may be applied according to step e1) in an amount which is smaller than the amount of the second resin-containing layer applied according to step e2). For example, the first resin-containing layer may be applied in process step e1) in an amount in a range of ≥10 g/m$^2$ to ≤25 g/m$^2$, for example, in a range of ≥15 g/m$^2$ to ≤20 g/m$^2$, and the second resin-containing layer may be applied in step e2) in an amount in a range from ≥20 g/m$^2$ to ≤40 g/m$^2$, for example in a range of ≥25 g/m$^2$ to ≤35 g/m$^2$.

It may be preferred that in process step e) a resin composition is applied which comprises as a solid at least one compound from the group consisting of titanium dioxide, barium sulfate, barium oxide, barium chromate, zirconium (IV)oxide, silicon dioxide, aluminum hydroxide, alumina, iron oxide, iron(III)hexacyanoferrate, chromium oxide, cadmium oxide, cadmium sulfide, cadmium selenite, cobalt oxide, cobalt phosphate, cobalt aluminate, vanadium oxide, bismuth vanadium oxide, tin oxide, copper oxide, copper sulfate, copper carbonate, lead antimonate, lead chromate, lead oxide, lead carbonate, calcium carbonate, calcium sulfate, calcium aluminate sulfate, zinc oxide, zinc sulfide, arsenic sulfide, mercury sulfide, carbon black, graphite, cellulose fibers or mixtures thereof. By using such solids, in particular a colored printing substrate can be provided, whose colouring has a characteristic supporting the decorative printing. Thus, for example, in a decorative design, that is to represent a dark wood species, a printing substrate with a brown or brownish base tone can be applied, while in a decorative design that is to represent a light wood species or a light-colored stone, a printing substrate with a yellow or white base tone can be applied. The use of cellulose fibers in the resin composition applied to the plate-shaped carrier has, in particular, the advantageous effect that any irregularities on the carrier plate surface onto which the resin composition is applied have no impact on the surface to be printed later, resulting in a significant improvement of the print image. Such irregularities may, for example, be grinding grooves resulting from grinding of the carrier plates or impressions caused by conveyor means, such as conveyor belts, etc. When cellulose fibers are used they preferably have a grain size in the range between ≥10 μm and ≤100 μm, in particular between ≥25 μm and ≤90 μm. The proportion of the cellulose fibers in the solid material included in the resin composition may, for example, be in a range between ≥0 wt.-% and ≤100 wt.-%., preferably between ≥40 wt.-% and ≤100 wt.-%, in particular between ≥60 wt.-% and ≤100 wt.-%. Here, the preferred proportion of solid materials in the resin composition in the case of using cellulose fibers is at the lower end of the wt.-% range, preferably between 0.5 wt.-% and 3.5 wt.-%, in particular between 1.0 wt.-% and 2.5 wt.-%, whereas the preferred proportion of solid materials in the resin composition listed as suitable examples of other solid materials is preferably between ≥5 wt.-% and ≤85 wt.-%, still preferably ≥10 wt.-% and ≤80 wt.-%, more preferably between ≥35 wt.-% and ≤75 wt.-%. This is particularly due to the low specific weight of the cellulose fibers which can be added as solid material compared to the specific weight of the other solid materials listed.

In particular, it may be provided according to the disclosure that in step e) a resin composition is applied which comprises at least one organic or inorganic pigment selected from the group consisting of Prussian blue, brilliant yellow, cadmium yellow, cadmium red, chromium oxide green, cobalt blue, cobalt coelin blue, cobalt violet, irgazine red, iron oxide black, manganese violet, phthalocyanine blue, sienna, titanium white, ultramarine blue, ultramarine red, umber, kaolin, zirconium silicate pigments, monoazo yellow and monoazo orange, thioindigo, beta-naphthol pigments, naphthol AS pigments, pyrazolone pigments, N-acetoacetic acid anilide pigments, azo metal complex pigments, diaryl yellow pigments, quinacridone pigments, diketopyrrolo-pyrrole pigments (DPP), dioxazine pigments, perylene pigments, isoindolinone pigments, copper phthalocyanine pigments, and mixtures thereof.

Furthermore, in one embodiment of the method it can be provided that in step e) a resin composition is applied which includes a curing agent, wherein the curing agent is included in the resin composition, for example, in a concentration between ≥0.05% and ≤3.0 wt.-%, preferably ≥0.15 wt.-% and ≤2.0 wt.-%, more preferably between ≥0.5 wt.-% and ≤2.0 wt.-%. The provision of a curing agent in the resin composition enables to optimize the setting or curing behavior of the resin composition depending on the paper applied onto the plate-shaped carrier and/or, moreover, to provide a particularly rapid provision of the printing substrate which can be advantageous in particular when a printing process is carried out directly after the application of the printing substrate.

According to one embodiment of the method the curing agent can, for example, include a solution of organic salts. The curing agent preferably has an acidic pH value, preferably between ≥pH 0.5 and ≤pH 7, still preferably ≥pH 0.5 and ≤pH 6.

In a particularly preferred embodiment of the disclosure, a so-called latent curing agent is used as a curing agent. Latent curing agents are characterized in that after their addition to the resin on the one hand a sufficient processing time at room temperature, and on the other hand a curing time as short as possible is achieved at the subsequent processing temperatures. The effect of the latent curing agents is due to the fact that they are ineffective at normal temperatures and only at increased temperatures or due to a chemical reaction they release an acid, which accelerates the curing process. Examples of latent curing agents are inter alia alkyl or alkanolamine salts of sulfuric acid, amidosulfonic acid, 3-chloro-1,2-propanediol, p-toluenesulfonic acid, morpholine, ammonium sulfate, ammonium chloride, ammonium sulfite, ammonium nitrate, ethanolamine hydrochloride, dimethylethanolammonium sulfite, diethanolammonium sulfamate or maleic acid.

In particular, the curing agent may be an aqueous, preferably nonionic solution. An example of a suitable curing agent is MH-180 B (Melatec AG, Switzerland).

At least one, for example all resin compositions applied in step e) in addition to the components mentioned above may comprise further components or additives such as rheological agents for adjusting the viscosity, water, flow improvers, preservatives, surfactants, antifoaming agents or the like.

In the method according to the disclosure both the application of a resin composition onto the plate-shaped carrier according to step b) as well as the application of a printing substrate onto the plate-shaped carrier according to step e) are carried out by means of application rollers, a spraying device, knife coating, blade coating, airbrushing, cast line devices, slot dies, curtain coating or other suitable devices.

After the application of the resin composition in step e), a drying step may follow in which at least the surface of the resin-containing layer is at least partially dried. For this purpose, it may be provided that on the surface onto which the resin composition has been applied, a surface temperature between ≥75° C. and ≤125° C., preferably between ≥80° C. and ≤110° C., in particular between ≥90° C. and ≤100° C. is produced. In order to produce a corresponding surface temperature, for example, IR emitters, NIR emitters, nozzle dryers or similar devices are suitable. The surface temperature mentioned is preferably set for a period between ≥1 s and ≤600 s, preferably between ≥5 s and ≤400 s, more preferably between ≥10 s and ≤300 s.

Subsequently to the drying of the printing substrate, for example by heat, moreover a subsequent treatment of the resin composition applied in process step e) and optionally dried, for example with UV radiation, can take place.

The thus treated plate or the carrier with the applied printing substrate can then be printed directly, in particular by use of flexographic printing, offset printing or screen printing methods, as well as in particular by means of digital printing techniques, such as inkjet methods or laser printing methods. In particular, the latter offer a high possible variance of the application amount, so that the method described here is particularly advantageous in digital printing techniques.

With respect to the printing and thus the formation of a decoration or a decorative layer on the carrier it is provided in a method described herein, that according to step f) the carrier is printed with an application amount of a radiation-curable printing paint, such as a radiation-curable ink. In particular, for the printing process a printing paint, such as an ink is used which can be cured by UV radiation and, thus, is UV-curable. It may in particular be provided that the printing paint and/or ink comprises corresponding radiation- or photo-induced polymerizing components and optionally suitable photoinitiators. Examples of suitable components are acrylates, epoxides or cyclic amines, such as ethyleneimine.

With regard to the use of a radiation-curable printing ink for printing the carrier it is provided in the method described herein that after printing the carrier a curing of the previously applied printing ink according to process step g) by treating the printing ink with radiation, in particular with UV radiation, is carried out.

Herein UV radiation can in particular be understood as a radiation having a wavelength in the range of, for example, 10-380 nm, such as 100-380 nm. Here, this kind of radiation can, for example, be generated in a manner known per se by use of medium pressure lamps. For example, a gas discharge lamp such as a mercury vapor lamp can be used or a UV-LED.

The use of a radiation-curable printing paint, such as a radiation-curable printing ink, has the advantage that the printing ink needs not to be subjected to a time consuming drying step, but can be cured relative quickly by the influence of, for example, UV radiation. Although the cured printing ink achieves its final hardness due to the curing mechanism and a corresponding complete hardening optionally only after a relatively large period of time, a further treatment of the carrier can be carried out already after the aforementioned very short time.

With regard to the abovementioned drying step or curing step according to step g), it is further provided in the method described herein according to step h) that at least one parameter of the radiation used in step g) is adapted to the application amount of radiation-curable ink.

It has surprisingly been found that in particular a method described above can enable a sufficient and particularly gentle curing of the radiation-curable ink within a short processing time.

In detail, by adapting the radiation or at least one parameter of the radiation to the application amount of the radiation-curable printing ink it can be achieved that the radiation is applied with one or more parameters that enable a curing of the printing ink in a sufficient way and wherein further high line speeds can be achieved. On the other side it can be enabled that the heat load of the carrier plate can be kept particularly low by a least possible exposure to radiation. This can allow a very gentle treatment of the carrier plate during the curing of the printing ink.

Furthermore, in contrast to otherwise usual equipment, according to which the radiation with uniform parameters is set, a particularly simple adaptability to the desired field of application or to the desired decoration is enabled. In this case, however, costly reconstruction measures can be dispensed with, since the curing is adapted by a simple adaptation of one or more parameters of the radiation used, which is optionally particularly easy to implement. As a result, production losses due to adaptation work can be reduced or completely avoided, thus increasing the productivity.

In addition, a significant energy gain can be achieved by an adaptation of the radiation and thus by limiting the radiation to parameters which are selected depending on the application amount. This can make the process particularly economical.

Furthermore, depending on the parameter setting the printed carrier may have different properties, such as chemical resistance, adhesion, scratch resistance, gloss, and wear sensitivity. Thus, by adapting the radiation parameters the printed carrier can be adapted in its properties to the desired field of application, such as to the subsequently performed treatment steps or potentially subsequently applied layers.

With regard to the parameters to be set, these can preferably be calibrated prior to a printing or hardening process being carried out, so that, for example, by means of a control unit, the corresponding parameter(s) can be adjusted particularly reliable when changing the application amount of the ink for example in a predetermined pattern. For example, the calibration can be based on or carried out by use of different printing inks or different travel speeds of the carrier, so that the distance between the printing unit and the radiation unit and the corresponding travel time of the carrier between the print head and the radiation unit can be included as well as the influence of different curing behaviors of different printing inks or different application amounts of printing inks.

It is provided that step h) is based on an application amount of the radiation-curable ink which is determined by at least one sensor during the printing process. In this embodiment, the application amount actually used can be detected accordingly for example by means of corresponding sensors and used. Thus, an adaptation of the curing process may not or not exclusively be based on preset values but can rather reflect the actual conditions of the printing process. As a result, curing can always be carried out by use of the correct parameters, even if the actual application amount deviates from the previously set values.

In particular, it may be provided that the application amount is determined by use of at least one sensor. In this embodiment, the application amount can thus be determined in situ and be forwarded to a control unit or a radiation unit which can simplify a highly accurate irradiation. In particular, the radiation unit can be driven for example by the control unit on the basis of the distance of the radiation unit from the print head in combination with the travel speed based on the specifically determined data of the application amount.

Here, in principle, it may be freely selectable whether only one sensor or a plurality of sensors are used. Furthermore, the choice of the sensor, that is to say in particular the operation principle of the sensor or sensors, is basically not restricted in the sense of the present disclosure. If a plurality of two or more sensors is used, the same or different sensors can be used.

In particular, in determining the specific application amount it may be advantageous to calibrate the corresponding sensor by determining the effect of different amounts of ink and possibly different types of inks or paints on the sensor, as already described above.

Accordingly, it is provided that at least one parameter of the radiation used in step g) is adapted during the printing of the carrier according to step f). In this embodiment, an adaptation is thus not carried out, as in principle is also possible, prior to the printing of an entire decoration, but at least partially prior to the printing of individual decoration areas. For example, an adaptation of the at least one parameter can take place simultaneously with a printing process.

The radiation thus does not need to be adapted to an averaged value or a minimum value or a maximum value of the application thickness, but rather an adaptation with respect to individual and possibly different areas of the decoration can be realized during the printing of the decoration. This allows a particular precise adjustment to the entire decoration image and therefore a particularly effective adaptation.

With respect to the sensor, it may be provided that the determination of the application amount of the radiation-curable ink is carried out during the printing process by use of at least one optical sensor which scans or detects a discharge area of a print head. For example, the transmission of radiation can be determined which is passed through the ink jet so as to obtain conclusions about the amount of ink and thus the application amount. This embodiment can allow a particularly accurate determination of the application amount. It may be advantageous if each print head is associated with a sensor or each of the print heads is provided with a sensor.

Alternatively or additionally, it may be provided that the determination of the application amount of the radiation-curable ink is carried out during the printing process by use of at least one optical sensor which detects the printed carrier. This embodiment can possibly be implemented in a particularly simple and cost-effective manner. Because in this embodiment, conventional print heads can be used without the need for a significant reconstruction thereof. In particular, in this embodiment, it may be advantageous if the determination of the application amount is implemented under consideration of the applied ink, that is, if the type of applied ink is introduced in the calculation. For this purpose, it can be determined, for example based on the control data, which ink should be discharged at which position.

Alternatively or additionally, it may be provided that the determination of the application amount of the radiation-curable ink is carried out during the printing process by use of a flow sensor which detects an ink line upstream of a print head or within a print head. In this case, the flow sensor, which is preferably provided on or in front of all corresponding print heads, determines the amount of ink which concretely flows to the print head or through the print head in a highly accurate manner. In this case, the position of the flow sensor can be advantageously selected depending on the system used.

It may further be provided that a warning is issued in the event of a deviation of the determined application amount from the desired application amount. In this embodiment it can thus be prevented, that in case of a malfunction of the print head excessive rejects are produced. Because based on the warnings a printing process may be interrupted or readjusted so as to allow a printing of the carrier in a desired manner. In this case, a warning can be issued, for example, if the deviation of the determined application amount from the desired application amount is outside predetermined thresholds, so as to enable a desired tolerance. The warnings can be issued in a variety of ways, such as by means of a warning tone or an optical indication. In order to protect the applied decorative layer moreover a wearing or cover layer may be applied on top of the decorative layer in a subsequent process step, which in particular protects the decorative layer from wear or damage by dirt, moisture or mechanical effects such as abrasion.

With regard to the wearing or cover layer it may be provided that the wearing layer comprises hard materials such as titanium nitride, titanium carbide, silicon nitride, silicon carbide, boron carbide, tungsten carbide, tantalum carbide, aluminum oxide (corundum), zirconia or mixtures thereof in order to increase the wear resistance of the layer. Herein, it may be provided that the hard material is included in the wearing layer composition in an amount between 5 wt.-% and 40 wt.-%, preferably between 15 wt.-% and 25 wt.-%. The hard material preferably has a mean grain diameter D50 between 10 μm and 250 μm, more preferably between 10 μm and 100 μm. In this manner it is achieved in a preferable way that the wearing layer composition forms a stable dispersion and a decomposition or precipitation of the hard material within the wearing layer composition can be avoided. For forming a corresponding wearing layer in one embodiment of the disclosure it is provided that the radiation-curable composition including the hard material is applied at a concentration between 10 g/m2 and 300 g/m2, preferably between 50 g/m2 and 250 g/m2. In this case, the application can be implemented, for example, by means of rollers such as rubber rollers, or by means of pouring devices. In a further embodiment of the disclosure it may be provided that the hard material is not included within the wearing layer composition at the time of application of the wearing layer composition but is scattered in the form of particles onto the applied wearing layer composition and subsequently the wearing layer is cured.

To this end, it may be preferred to apply a curable composition as the cover and/or wearing layer and a curing process is implemented prior to introducing the structure only to such an extent that only a partial curing of the cover and/or wearing layer is achieved. In the thus partially cured layer by means of appropriate tools, such as a hard metal texture roller or a die or a press, such as a short-cycle press, a desired surface structure is embossed. Herein, the embossing process is implemented in correspondence with the applied decoration. In order to ensure a sufficient correspondence of the structure to be produced with the decoration it may be provided that the carrier plate and the embossing tool are aligned relative to each other by corresponding relative movements, such as based on corresponding optical marks. Subsequently to the introduction of the desired structure within the partially cured cover and/or wearing layer a further curing step such as a final curing is implemented with respect to the now structured cover and/or wearing layer.

Moreover, it can be provided that the wearing and/or cover layer is applied as a resin layer, such as a melamine resin layer, or as a radiation-curable or at least partially radiation-curable composition, for example based on an acrylic varnish, an epoxy varnish or a urethane acrylate.

Moreover, the cover and/or wearing layer can comprise agents for reducing the static (electrostatic) charging of the finished laminate. For example, it may be provided that the cover and/or wearing layer comprises compounds such as choline chloride. Herein, the antistatic agent may, for example, be included in the composition for forming the cover and/or wearing layer at a concentration between ≥0.1 wt.-% and ≤40.0 wt.-%, preferably between ≥1.0 wt.-% and ≤30.0 wt.-%.

Moreover, it can be provided that the structure is produced in the course of the printing process. For this purpose, it may be provided, for example, that a multiple ink application, for example, with a partial or complete curing is implemented in such a way that raised areas are created on the printing substrate which result in a desired three-dimensional structure. On top of the structure thus produced then a wearing and/or cover layer can be applied.

On the side opposite the decorative side, a backing layer can be applied. Here, it is particularly preferred that the backing layer is applied in a common calendering step with the paper or nonwoven on the decorative side or independently. In a further embodiment of the disclosure, it may be provided that a backing layer is applied to the side opposite the decorative layer of the plate-shaped carrier only after the application of the decorative image. It may be provided in particular that the backing layer is applied in a common step with the application of an overlay as cover and/or wearing layer.

In particular, however, it may be preferred within the scope of the disclosure if the application of a backing layer is dispensed with.

Moreover, the plate-shaped carrier can comprise a profile at least in an edge region. Here, it may be in particular provided that the decoration is applied also in the region of the profile, such that the profiling process is implemented prior to the application of the decorative layer onto the plate-shaped carrier. Alternatively or in addition, a profiling process can also be implemented subsequently to the application of the decorative layer. In profiling in the sense of the disclosure it is provided that by means of suitable machining tools at least in a portion of the edges of the decorative panel a decorative and/or functional profile is introduced. Here, a functional profile, for example, means the introduction of a groove and/or tongue profile in an edge in order to make decorative panels connectable to each other by means of the introduced profiles. A decorative profile in the sense of the disclosure, for example, is a chamfer formed at the edge region of the decorative panel, for example, in order to simulate a joint between two interconnected panels after their connection, such as for example in so-called wide planks.

By partially profiling of the decorative panel not all profiles to be provided in the finished panel are produced, but only part of the profiles, while other profiles are produced in a subsequent step. Thus, it may be provided, for example, that the decorative profile to be provided in a panel, such as a chamfer, is produced in one step, while the functional profile, e.g. groove/tongue, is produced in a subsequent step.

By means of the application of the decoration only subsequently to the at least partially profiling of the carrier, for example, by means of the above-described methods, such as direct printing, abrasion or damage of the decoration in the course of the profiling process is avoided in an advantageous way. Thus, the decoration also in the regions of the profile corresponds in detail to the desired imitation, for example, of a natural material.

In summary, the above-described method can enable a high adaptability with simultaneously high throughput and gentle processing.

It can be provided that method step h) is based on a predetermined application amount of the radiation-curable ink. In this embodiment, at least one parameter of the radiation used can be adapted based on an application amount which is forwarded, for example, from a control unit to the printing unit or to one or more print heads. Thus, for example, a control signal for the print heads can be transmitted accordingly to a radiation device, which based on the application amount thus transmitted adjusts the parameters for a radiation-based curing of the printing ink. In this embodiment, the method can be realized particularly cost-efficiently, since it is possible to dispense with any sensors or the like which detect the application amount. In addition, for example, a print image to be printed or the amount of printing ink associated therewith may be taken into consideration in advance which, thus, may also include any setting delays of the parameters.

Furthermore, it can be provided that at least one parameter of the radiation used in step g) is adapted independently of one another and, for example, differently, in a plurality of regions which are locally different from one another. In this embodiment it is enabled in a particularly advantageous manner that even if different application amounts of radiation-curable printing ink are applied in different areas of the carrier plate, at least one radiation parameter can be adapted particularly effectively. In this case, the locally different areas may be provided or arranged parallel to a travel direction of the carrier plate and/or the locally different areas may be arranged in a direction perpendicular to the travel direction of the carrier. Regarding the travel direction this is in particular the direction in which the carrier plate is transported through a printing unit. Again, this embodiment can in turn enable a particularly accurate adjustment with respect to the entire decoration image and, thus, a particularly effective adaptation.

Furthermore, it can be provided that the at least one adapted parameter of the applied radiation comprises the number of emitters. In this embodiment, the adaptation of the at least one radiation parameter can be implemented particularly simple, since an adjustment of this parameter can be handled without any problems by an appropriate controller and, moreover, commercial emitters can be used. As a result, a realization is particularly easy. In this case, the number of emitters, i.e. the emitters which are active or in operation during the curing process, can be adjusted in a direction which is parallel to the travel direction of the carrier plate and/or in a direction perpendicular thereto.

Alternatively or additionally, it may be provided that the at least one adapted parameter of the applied radiation comprises the power of at least one emitter. In this embodiment, thus, the power of one or more emitters can be varied, whereby a particularly accurate and defined adaptation may be enabled. As a result, in this embodiment, a high degree of adaptation is always continuously achieved even with comparatively small differences in the application amount.

Alternatively or additionally, it may be provided that the at least one adapted parameter of the applied radiation includes the irradiation duration of the radiation-curable printing ink. This parameter can be adjustable, for example, by a variation of the line speed of the carrier plate, that is to say the speed with which the printed carrier plate passes through a radiation unit. This parameter, too, may enable the effect of the radiation onto the ink and thus an adaptation of the curing conditions in an effective way.

In principle, it may be provided in the method described herein that step g) is realized by use of a power of the radiation, which in particular is incident on the surface of the irradiated substrate in a range of ≥100 W/cm to ≤200 W/cm, preferably from ≥110 W/cm to ≤170 W/cm, for example from ≥120 W/cm to ≤160 W/cm, such as 145 W/cm.

For example, one radiation source or a plurality of radiation sources can be used, which can be arranged one behind the other and/or next to each other in the transport direction of the carrier. In an exemplary wavelength range of 230-410 nm and by use of three emitters connected in series with an exemplary power of 145 W/cm, the total dose of irradiation incident on the printing ink can be adjusted, for example, to a range of ≥400 mJ/cm$^2$ to ≤1200 mJ/cm$^2$, in particular ≥600 mJ/cm$^2$ to ≤1000 mJ/cm$^2$, for example from ≥700 mJ/cm$^2$ to ≤900 mJ/cm$^2$, such as 830 mJ/cm$^2$. Thus, the dose applied to the ink can be a suitable parameter to be adapted according to the disclosure.

For example, when using three UV emitters connected in series, for example, a dwell time in the direct focus of the emitter, that may have a range corresponding to the travel direction of the carrier of approximately 10 mm, may be by way of example approximately 0.024 seconds, wherein the dwell time in an extended focus, which may have a range corresponding to the travel direction the carrier of about 50 mm, may be about 0.12 s.

In principle, total irradiation durations, which may include both the direct focus and the extended focus, in a range of ≥0.05 s to ≤20 s, preferably 0.1 s to 2 s, such as 0.2 s to ≤0.5 s may be present. To achieve the above values, for example, a speed of the carrier may be set in a range of, for example, 25 m/min.

With regard to further advantages and technical features of the method described above, reference is expressly made to the following description of the device, to the figures and to the description of the figures, and vice versa.

The subject matter of the present disclosure is further a device for producing a printed panel comprising

- a supply means for supplying a plate-shaped carrier;
- optionally an application unit for applying a resin layer onto the supplied carrier;
- optionally a supply means for applying a paper or a nonwoven layer onto the plate-shaped carrier;
- optionally a unit for calendering a layer structure comprising the carrier, the resin layer and the paper or nonwoven layer;
- optionally an application unit for applying a printing substrate onto the carrier;
- a printing unit for printing the carrier with a radiation-curable ink; and
- a radiation unit for treating the printed carrier with radiation for curing the radiation-curable printing ink, wherein it is further provided:
- a control unit, which can be fed with data of at least one sensor relating to an application amount of the radiation-curable ink determined during the printing process, wherein the control unit determines at least one parameter of radiation emitted by the radiation unit on the basis of the application amount, and which is connected to the radiation unit by a data connection for transmitting the at least one parameter, and wherein the irradiation by the radiation unit is executable on the basis of the at least one parameter.

By means of a device described above it can be achieved that a panel is printed with a radiation-curable printing ink and the printing ink is radiation-cured, wherein in particular the curing process can be particularly effective and gentle.

With regard to the specific features and advantages of such a device, reference is made to the method described above in detail.

With regard to further advantages and technical features of the device described above, reference is expressly made to the description of the method, to the figures, and to the description of the figures, and vice versa.

The disclosure is explained below with reference to the figures and an exemplary embodiment.

Corresponding reference numerals indicate corresponding parts throughout the several views of the drawings.

DETAILED DESCRIPTION

Example embodiments will now be described more fully with reference to the accompanying drawings.

Figure 1:
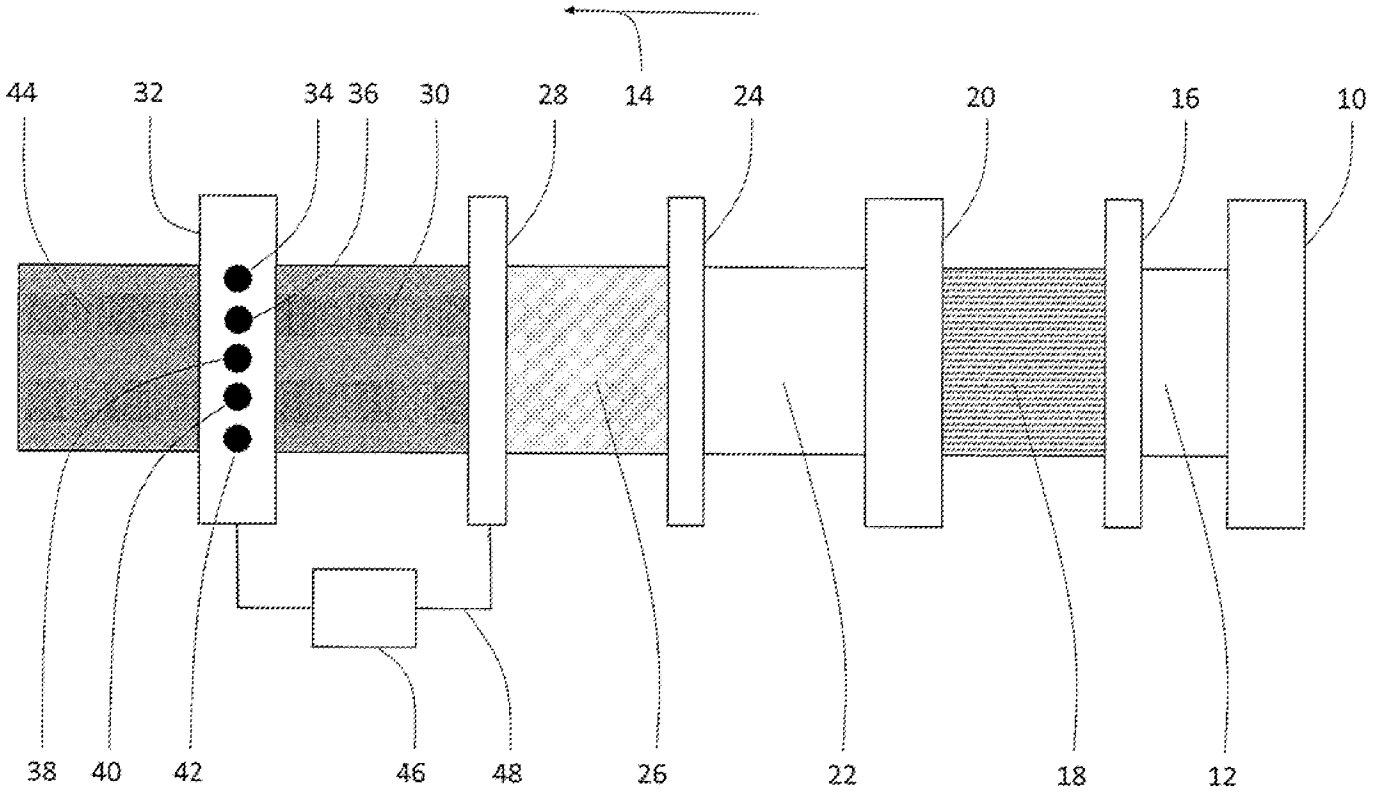
FIG. 1 shows a device in an embodiment of the disclosure in a first operating mode.

FIG. 1 shows a device for producing a printed panel in an embodiment of the present disclosure for carrying out a method according to the present disclosure.

The device comprises a supply means 10 for supplying a plate-shaped carrier 12, so that the carrier 12 is transported in the direction of the arrow 14 the a travel direction. Downstream of the supply means 10 an application unit 16 for applying a resin layer 18 onto the supplied carrier 12 is disposed. In the travel direction downstream of the application unit 16 a supply means 20 for applying a paper or nonwoven layer 22 onto the plate-shaped carrier 12 is arranged. Not shown is an adjoining unit for calendering, in particular under heat, of a layer structure comprising the carrier, the resin layer 18 and the paper or nonwoven layer 22.

In order to prepare a printing of the carrier 12 according to FIG. 1, moreover, an application unit 24 for applying a printing substrate 26 onto the carrier 12 is provided. In the travel direction of the carrier 12 downstream of the application unit 24, a printing of the carrier 12 may follow. For this purpose, a printing unit 28 for printing the carrier 12 with an application amount of radiation-curable printing ink 30 is provided. In order to cure the radiation-curable printing ink 30, a radiation unit 32 for treating the printed carrier with radiation for curing the radiation-curable printing ink 30 is provided, so that the carrier 12 is provided with cured printing ink 44. With reference to the radiation unit 32 it is shown in FIG. 1 that the radiation unit 32 has five emitters 34, 36, 38, 40, 42. These can be arranged side by side, but basically any arrangement of the emitters 34, 36, 38, 40, 42 can be encompassed by the present disclosure.

In FIG. 1 it is further shown that the device comprises a control unit 46, which, for example, is connected to the printing unit 28 and the radiation unit 32 for data transmission by means of a data connection 48. As a result, the control unit 46 can be fed with data relating to an application amount of the radiation-curable printing ink 30 and can determine at least one parameter of the radiation emitted by the radiation unit 32 based on the application amount. The data relating to the application amount can correspond to the data transmitted to the printing unit 28 or can be generated by sensors (not shown) for determining the applied printing ink 30.

The number of sensors used and not shown in detail of the printing unit 28 and their respective configuration is in principle not limited. For example, determination of the application amount of the radiation-curable printing ink during the printing process can be carried out by use of at least one optical sensor that detects a discharge area of a print head. Alternatively or additionally, it may be provided that the determination of the application amount of the radiation-curable printing ink is carried out during the printing process by use of at least one optical sensor that detects the printed carrier. Alternatively or additionally it may be further provided that the determination of the application amount of the radiation-curable printing ink is carried out during the printing process by use of a flow sensor, which detects an ink line upstream of a print head or within a print head.

This allows the control unit 46 to transmit the at least one parameter to the radiation unit 32. The radiation unit 32 in turn can cure the printing ink 30 by use of this parameter. This is likewise shown in FIGS. 2 and 3, and the above description can similarly be applied to the FIGS. 2 and 3.

FIG. 1 shows that a comparatively large application amount of radiation-curable printing ink 30 is applied onto the carrier 12. In order to cure the printing ink 30, therefore, all five emitters 34, 36, 38, 40, 42 are used.

Figure 2:
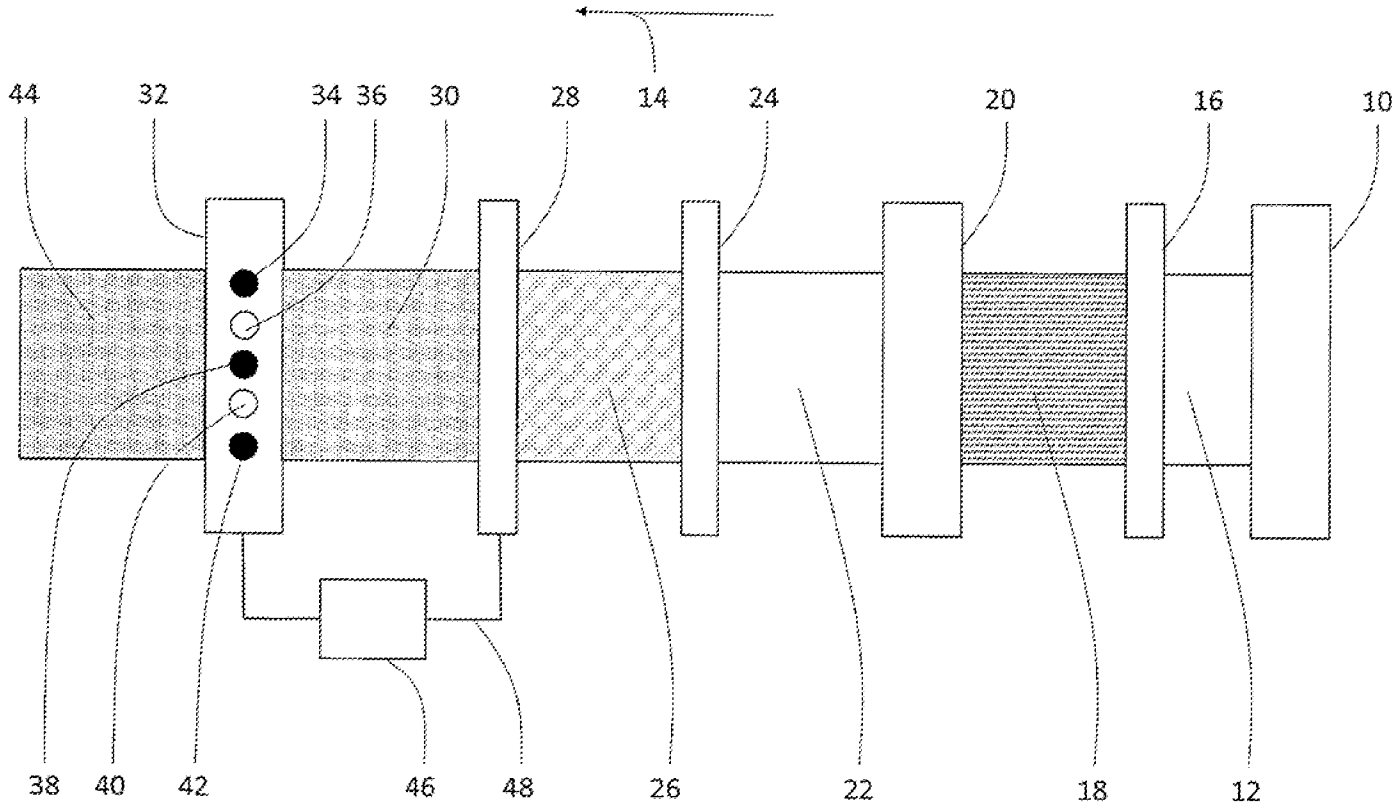
FIG. 2 shows the device of FIG. 1 in a second operating mode.

In FIG. 2 it is indicated that a comparatively small application amount of radiation-curable printing ink 30 is applied onto the carrier 12. In order to cure the printing ink 30 therefore only three emitters 34, 38, 42 are used.

Figure 3:
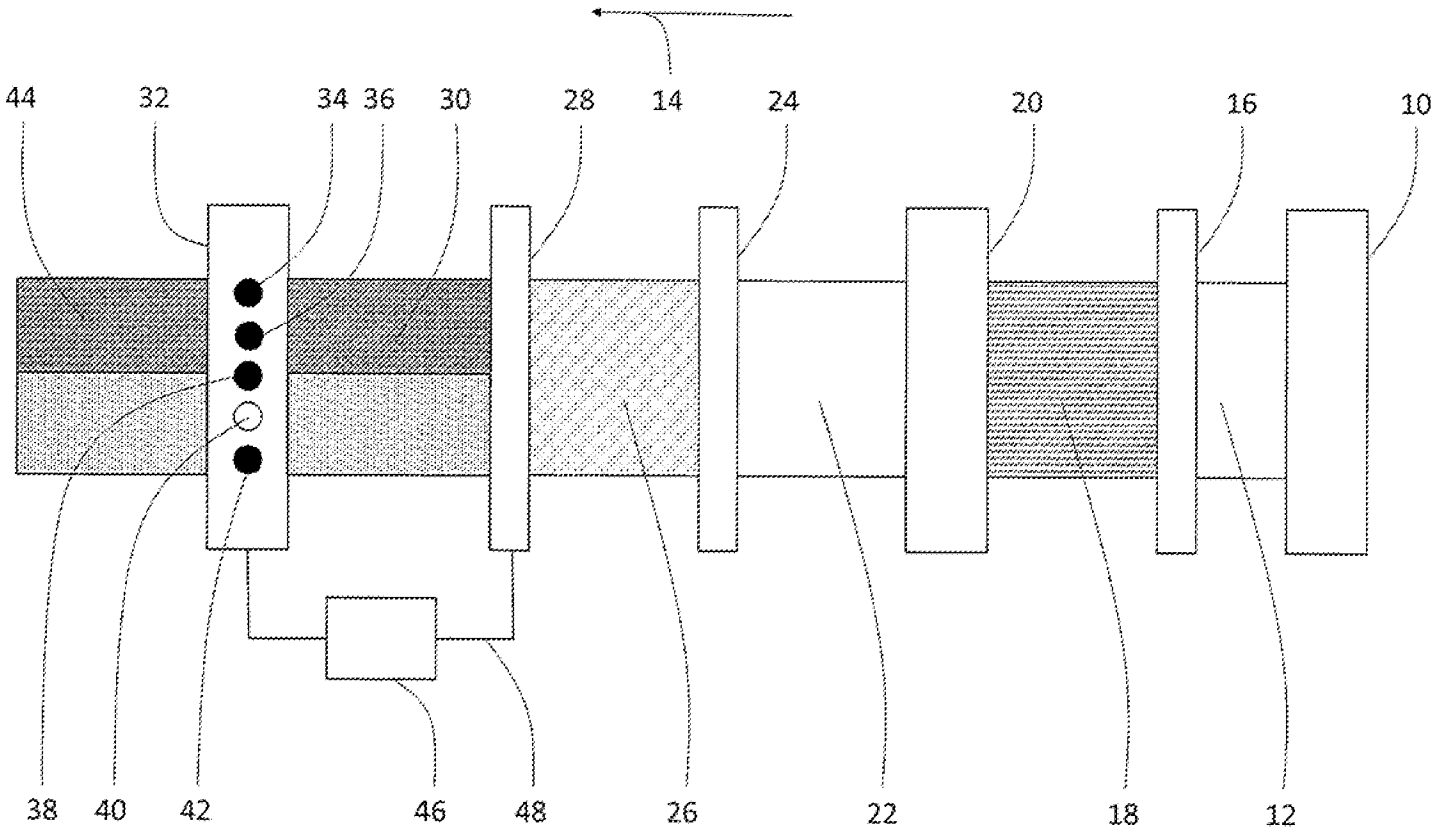
FIG. 3 shows the device of FIG. 1 in a second operating mode.

FIG. 3 shows a further example. According to FIG. 3, a part of the printing ink 30 is applied onto the carrier 12 with a comparatively small application amount of radiation-curable printing ink 30 and additionally also a part of the printing ink 30 is applied onto the carrier 12 with a comparatively high application amount of radiation-curable ink 30. In this case, a curing or irradiation of the printing ink 30 can take place locally differently by use of the emitters 34, 36, 38 and 42. It can be seen that a versatile adaptation can be achieved even with differently printed decoration areas.

Regardless of the specific embodiment of the device or the method, by use of five emitters 34, 36, 38, 40, 42, for example, the following parameter selection can be done, wherein the application amounts are related to the entire decoration. With an application amount of $<2$ g/m$^2$, for example, one emitter can be used, with an application amount of $\geq 2$ g/m$^2$ to $<5$ g/m$^2$, for example, two emitters can be used. With an application amount of $\geq 5$ g/m$^2$ to $<8$ g/m$^2$, for example, three emitters can be used, with an application amount of $\geq 8$ g/m$^2$ to $<10$ g/m$^2$, for example, four emitters can be used, and with an application amount of $\geq 10$ g/m$^2$, for example, five emitters can be used, wherein the above values being purely exemplary.

Specifically, it is in principle possible, for example, that for a given UV-curable ink with applied amounts of ink of $<1$ ml/m$^2$ one UV emitter is used, wherein the ink is exposed to a dose of 280 mJ/cm$^2$. Furthermore, it can be provided that with applied amounts of ink of $\geq 1$ ml/m$^2$ to $\leq 5$ ml/m$^2$ two consecutively arranged UV emitters are used, wherein the ink is exposed to a dose of 550 mJ/cm$^2$, and that with applied amounts of ink of >5 ml/m$^2$ three consecutively arranged UV emitters are used, wherein the ink is exposed to a dose of 830 mJ/cm$^2$. The feed rate of the panel is 25 m/min in all examples. Here, when using three consecutively arranged UV emitters, for example, a dwell time in the direct focus of the emitter, which may have an area corresponding to the moving direction of the carrier of about 10 mm, can be, for example, about 0.024 s, wherein the dwell time in an extended focus, which may have an area corresponding to the moving direction of the carrier of about 50 mm, can be about 0.12 s. Further, the dose was measured in the wavelength range 230-410 nm using a mercury emitter.

In a manner which is obvious to a person skilled in the art, the abovementioned parameters may differ in addition to the specific ink used, for example, based on a doping of the emitter.

The dose can be determined, for example, by a product marketed under the name "UV-Micro-Puck" by UV-Technik Meyer GmbH.

The abovementioned adaptations are further dependent on the desired curing result, which is realized by the effect of the emitter on the ink. Thus, the radiation used to act on the ink may be selected in particular against the background that the ink is optionally compressed together with a layer disposed on the ink, such as a melamine resin layer or lacquer layer, for introducing haptically perceptible structures. For this purpose, optionally a stronger hardening or a stronger dose acting on the ink may be necessary than with an ink layer which is not subjected to compression.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are to be regarded as a departure from the disclosure, and all such modifications are intended to be included within the scope of the disclosure.

The invention claimed is:

1. A method for producing a printed panel, comprising the steps:

a) providing a plate-shaped carrier;

b) optionally applying a resin layer onto the plate-shaped carrier;

c) optionally applying a paper or nonwoven layer onto the plate-shaped carrier;

d) optionally calendering the resulting layer structure, in particular at a temperature between ≥40° and ≤250° C.;

e) applying a printing substrate onto the plate-shaped carrier;

wherein the method comprises the further steps:

f) printing the carrier with a radiation-curable printing ink;

g) curing the previously applied printing ink by treating the printing ink with radiation, h) obtaining a signal from at least one sensor during printing step f), wherein the signal is indicative of the amount of radiation-curable ink being printed on the carrier; and i) varying at least one parameter of the radiation used in step g) based on the signal.

2. The method according to claim 1, wherein a warning is issued in case of a deviation of the determined application amount from the desired application amount.

3. The method according to claim 1, wherein step h) is based on a predetermined application amount of the radiation-curable ink.

4. The method according to claim 1, wherein at least one parameter of radiation used in step g) is adapted independently in a plurality of locally different areas.

5. The method according to claim 1, wherein step f) is realized by use of a digital printing method.

6. The method according to claim 1, wherein varying the at least one parameter of radiation includes varying a number of emitters, a power of at least one emitter, or an irradiation duration of the radiation-curable printing ink.

7. The method according to claim 1, wherein obtaining the signal includes the at least one sensor determining the amount of radiation-curable ink being printed on the carrier by detecting a discharge area of a print head.

8. The method according to claim 1, wherein obtaining the signal includes the at least one sensor determining the amount of radiation-curable ink being printed on the carrier by determining the amount of ink which flows to a print head.

* * * * *